US008653453B2

(12) United States Patent
Huq et al.

(10) Patent No.: US 8,653,453 B2
(45) Date of Patent: Feb. 18, 2014

(54) MASS DISCRIMINATOR

(75) Inventors: Ejaz Huq, Didcot (GB); Austin Bradley, Didcot (GB); Barry Kent, Didcot (GB)

(73) Assignee: The Science and Technology Facilities Council, Harwell Innovation Campus, Rutherford Appleton Laboratory, Oxfordshire (GB)

( * ) Notice: Subject to any disclaimer, the term of this patent is extended or adjusted under 35 U.S.C. 154(b) by 0 days.

(21) Appl. No.: 13/122,932

(22) PCT Filed: Oct. 7, 2009

(86) PCT No.: PCT/GB2009/002399

§ 371 (c)(1), (2), (4) Date: Apr. 6, 2011

(87) PCT Pub. No.: WO2010/041010

PCT Pub. Date: Apr. 15, 2010

(65) Prior Publication Data

US 2011/0198494 A1 Aug. 18, 2011

(30) Foreign Application Priority Data

Oct. 7, 2008 (GB) ..... 0818342.8

(51) Int. Cl.
*H01J 49/04* (2006.01)
*H01J 49/22* (2006.01)

(52) U.S. Cl.
USPC ..... 250/288; 250/294

(58) Field of Classification Search
USPC ..... 250/281, 282, 288, 289, 294, 298, 299
See application file for complete search history.

(56) References Cited

U.S. PATENT DOCUMENTS

| | | | | |
|---|---|---|---|---|
| 3,911,272 | A * | 10/1975 | Conzemius | 250/281 |
| 5,386,115 | A * | 1/1995 | Freidhoff et al. | 250/281 |
| 7,294,224 | B2 * | 11/2007 | Vesci et al. | 156/345.46 |
| 2006/0192108 | A1 * | 8/2006 | Yeatman et al. | 250/288 |
| 2006/0284075 | A1 * | 12/2006 | Bonne et al. | 250/288 |
| 2009/0010805 | A1 * | 1/2009 | Raynor et al. | 422/68.1 |
| 2009/0214391 | A1 * | 8/2009 | Scurati | 422/100 |

FOREIGN PATENT DOCUMENTS

| | | | |
|---|---|---|---|
| EP | 0 433 936 | A2 | 6/1991 |
| EP | 0433936 | A2 * | 6/1991 |
| GB | 2 026 231 | A | 1/1980 |
| GB | 2026231 | A * | 1/1980 |
| GB | 2 384 908 | A | 8/2003 |
| GB | 2 411 046 | A | 8/2005 |
| GB | 2411046 | A * | 8/2005 |

* cited by examiner

*Primary Examiner* — Robert Kim
*Assistant Examiner* — David E Smith
(74) *Attorney, Agent, or Firm* — Birch, Stewart, Kolasch & Birch, LLP

(57) ABSTRACT

An analysis device for mass discrimination is disclosed. The analysis device comprises: a sample chamber for holding a gaseous sample; an analysis chamber arranged to receive sample gas from the sample chamber; a mass discriminator arranged to discriminate in the analysis chamber between ion species generated from the sample gas; and a wall separating the sample chamber from the analysis chamber, the wall comprising a rupture zone controllable to rupture and thereby release sample gas from the sample chamber into the analysis chamber. In one embodiment the rupture zone is adapted to rupture on application of an electric current or mechanical force. The wall may be micromachined. A method of mass discrimination is also disclosed.

49 Claims, 7 Drawing Sheets

MASS DISCRIMINATOR

TECHNICAL FIELD

The present invention relates to a mass discriminator. In particular, the mass discriminator may comprise a micromachined element, and a controller.

BACKGROUND ART

Mass spectrometers are analytical instruments that measure the mass-to-charge ratio of ions to allow the composition of a sample to be determined. They comprise three basic parts: an ion source; a mass separator; and one or more detectors. The ion source converts a gaseous sample into ions. The mass separator separates out ions of differing mass-to-charge ratio such that different ion species are incident on different detectors, or different parts of the same spatially sensitive detector. Commonly, the sample is ionised by electron bombardment, influence of a large electric field, or thermal ionisation, etc. A number of techniques are also known for performing the mass separation. For example, ions having different mass-to-charge ratios will be deflected by combinations of electric and magnetic fields by differing amounts. Hence, application of electric and magnetic fields across the path of the ions may be used to separate them into different species.

The majority of mass spectrometers are heavy items that take up a large amount of space.

Efforts have been made to reduce the size of mass spectrometers to enable them to be portable. For example, GB 2026231 describes such a device. Nevertheless, such devices continue to be large and expensive.

GB 2384908 and GB 2411046 describe miniature mass spectrometers. These devices require precision fabrication. The latter device also requires fine control of the flow of the gas sample. This is achieved by the use of a membrane.

All of the prior art devices are expensive. Some offer longer periods of operation and greater accuracy than others.

In medical diagnosis, it would be desirable to have accurate single use devices for testing of patients. After use the device would be disposed of, thereby avoiding passing on infection to other patients. Such a device would ideally be small and compact and the result could be easily and quickly obtained, perhaps by a nurse or patient's general practitioner or physician.

SUMMARY OF THE INVENTION

The present invention seeks to overcome problems of the prior art. Accordingly, the present invention provides an analysis device, such as a mass discriminator element, component, or subsystem, comprising: a sample chamber for holding a gaseous sample; an analysis chamber arranged to receive sample gas from the sample chamber; a mass discriminator arranged to discriminate in the analysis chamber between ion species generated from the sample gas; and a wall separating the sample chamber from the analysis chamber, the wall comprising a rupture zone controllable to rupture and thereby release sample gas from the sample chamber into the analysis chamber. The rupture may also be known as a breach zone and or a frangible part. After rupture, an aperture is created joining the two chambers. Because of the rupture zone, the device is a single use disposable device. By the term "mass discriminator" we mean a mass spectrometer that is able to discriminate between a small number of ions, rather than being able to identify any ion species (or more correctly ion having a specific mass to charge ratio) as full mass spectrometers are capable of. Such an analysis device finds application in breath analysis. Multiple analysis devices may be used together (for example in a stack) to discriminate between more ion species than a single analysis device.

The sample chamber may be an open or closed chamber. If the chamber is closed, this may be by an admission valve arranged for introduction of said sample into the sample chamber.

The rupture zone of the wall may be adapted to rupture on application of an electric current by a controller. Hence, the rupture zone may, at least in part be made of fuse material which melts on application of electric current. The rupture zone may be comprised of a thinner section than the rest of said wall.

The analysis device may be manufactured by micromachining, printing, electroplating, LIGA, or micromilling etc. Printing and electroplating may be particularly useful for deposition of conductive or fusible materials for the electrodes. If printing is used for any of the electrodes, the metal will be in the form of a powder with a binding matrix. All electrodes are fabricated on a non-conducting substrate which may be made of glass, silicon, silica, or a combination of thereof. The rupture zone may be comprised of a metal film.

The analysis device may further comprise: an ion preparation region for generating ions from the sample. There may also be a lensing region arranged to focus the ions into an ion beam; a magnet arranged for deflecting the ion beam; and detectors arranged to detect incident ions.

The ion preparation region may comprise a pair of spark electrodes having a gap between through which the sample gas can flow, the pair of spark electrodes arranged such that application of sufficient potential difference across the electrodes results in an electrical discharge being generated thereby ionising the sample as it flows through said gap. The ion preparation region may further comprise a pair of ion extraction electrodes. The ion extraction electrodes are arranged to provide an electric field in the region of the spark electrodes. The ion extraction electrodes and fused aperture in the rupture zone are sized to regulate the flow of gas from the sample chamber to the mass discriminator chamber.

Prior to introduction of the sample into the sample chamber, the sample chamber and analysis chamber may be evacuated, for example to a pressure less than $10^{-1}$ Pa ($10^{-3}$ mb) or $10^{-2}$ Pa ($10^{-4}$ mb). The spark electrodes may be spaced, and the magnitude of the potential difference across them may be such that the electrical discharge is generated when the pressure rises above a threshold. The electrodes may be held at a fixed voltage or pedestal voltage such that the pressure rises until sufficient for electrical breakdown and the generation of a spark. The pressure will continue to rise after the spark has been initiated. The threshold pressure may be around 10 Pa (0.1 mb) or 100 Pa (1 mb). After the spark, the pressure in the analysis chamber is controlled by the gap between the various electrodes and the size of the rupture. The voltage across the electrodes of the lensing region and the controlled pressure rise maintains the spark process and allows the measurement process to proceed for long enough to obtain a reliable measurement.

The lensing region may comprise an Einzel lens.

The magnet may comprises Neodymium Iron Boride or another material. The magnet may instead be an electromagnet. Preferably a pair of magnets are provided.

A getter material may be provided in the analysis chamber. By the term getter material we mean a material for absorbing trace amounts of gas.

The analysis device may be manufactured by micromachining. The analysis device may be arranged as a substantially planar device, having electrodes and apertures arranged in a single plane such that the ion species travel along a path in that plane. The magnets arranged to deflect the ions are arranged to provide a field perpendicular to the plane, and as a result are likely to be the only component that lies out of the plane of the element. The analysis device may be arranged with apertures between the electrodes lying on a common axis, said axis may be offset from the centre of the device.

The device may also comprise electrical terminals to connect at least one of: the rupture zone, ion preparation region, lensing region, and detectors, to an external controller.

There is also provided an analysis system or mass discriminator system comprising the analysis device, and further comprising a controller arranged to provide the electric fields and current to the electrodes and rupture zone.

The controller may comprise a current source and a switch. Additionally, it may comprise voltage sources, further switches, and a meter for monitoring the currents received on the detectors. The controller may also include a timing device for timing the application of voltages to the electrodes, especially the current to the rupture zone and the spark gap.

The analysis system may further comprise readout means such as a display or set of LED indicators to display the result of the discrimination to the user. The readout means may be provided in a separate base unit or card reader into which the analysis device can be plugged, for example, after the sample has been received in the sample chamber, after the sample has been introduced into the analysis chamber, or after the discrimination event has occurred. In this way, the analysis device may be considered to be a cartridge which is received by a socket or caddy of the base unit.

The present invention also provides a method of mass discrimination using an analysis device comprising a sample chamber and an analysis chamber separated from the sample chamber by a wall, the wall comprising a rupture zone controllable to rupture, the method comprising the steps of: introducing a gaseous sample into the sample chamber; applying an electric current to cause the wall to rupture at the rupture zone to release the sample through the wall into the analysis chamber; applying a potential difference across a pair of spark electrodes in the analysis chamber to generate an electrical discharge across the electrodes, the electrical discharge ionising the sample; and discriminating between the ion species generated from the sample gas.

During manufacture of the analysis device, the sample chamber and analysis chamber are evacuated. This vacuum is retained until the gaseous sample is introduced into the sample chamber. The sample chamber and analysis chamber may be evacuated to a pressure of less than $10^{-2}$ Pa.

The electrical discharge across the spark electrodes may occur after the pressure in the or part of the analysis chamber exceeds a threshold. The threshold of the pressure in the or part of the analysis chamber may be around 100 Pa.

BRIEF DESCRIPTION OF THE DRAWINGS

Embodiments of the present invention, along with aspects of the prior art, will now be described with reference to the accompanying drawings, of which:

FIG. 2 shows the wall prior to rupture;

DETAILED DESCRIPTION OF THE PREFERRED EMBODIMENTS

Figure 1:
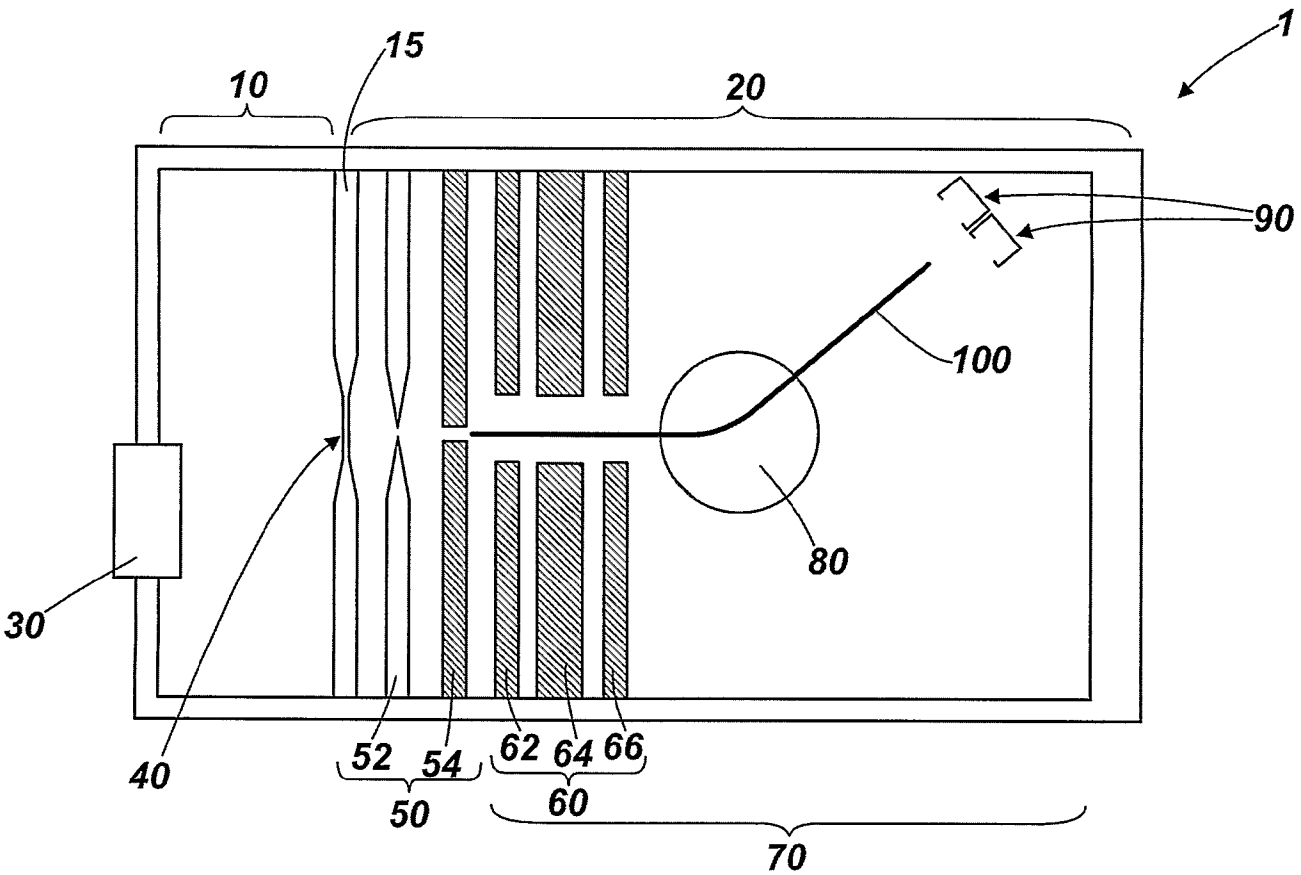
FIG. 1 is a schematic diagram of the mass discriminator element according to a first embodiment.

FIG. 1 shows a first embodiment of an analysis device or mass discriminator element 1. The analysis device comprises a sample chamber 10 and a mass discriminator chamber 20. The mass discriminator chamber 20 may be considered to contain two regions, namely, an ion preparation region 50 and an analysis region 70. The ion preparation region 50 has the same function as the ion source in conventional mass spectrometers.

The two chambers may be manufactured from clean, low outgassing materials to allow a vacuum to be created and maintained within the chambers 10, 20. In addition, a getter material, that is a material for removing traces of gas from vacuum systems, may be included in the analysis region 70.

The sample chamber 10 is arranged to enclose a volume of the sample. The sample is introduced into the sample chamber 10 through admission valve 30. This valve 30 may be a micro valve based on a silicon diaphragm, a puncture system, or a break-by-blow system, and may be located at any position on the perimeter or edge of the sample chamber 10.

The sample chamber 10 and mass discriminator chamber 20 are separated by a wall 15. This wall 15 includes a region which can be broken to provide an aperture to allow material to pass from the sample chamber 10 to the discriminator chamber 20. This may be achieved by including in the wall 15 a pre-weakened section, such as a section that is of reduced thickness compared to the rest of the wall 15 such that controlled rupture of the pre-weakened section results in the aperture being provided. The section adapted to rupture is known as the rupture zone, though may also be known as a breach zone, or a frangible section.

In the particular embodiment illustrated in FIG. 1, the pre-weakened section in the wall 15 is provided as a fusible device 40 manufactured as a thin metal membrane. When a current is applied across the fusible device, heating occurs causing the membrane to melt, or fuse, and thus opens the aperture. An example of a fusible device 40 is shown in more detail in FIGS. 2 and 4. Various modifications may be made to the fusible device of FIGS. 2 and 4, and alternative fusible devices may be used.

Figure 2:
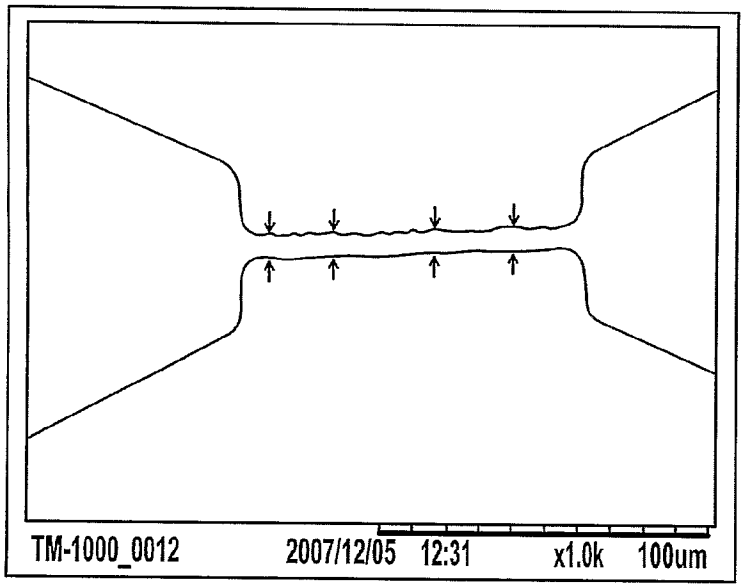
FIG. 2 is a micrograph of a wall having a rupture zone, the wall may be for separating two chambers of the embodiment of FIG. 1.
Figure 3:
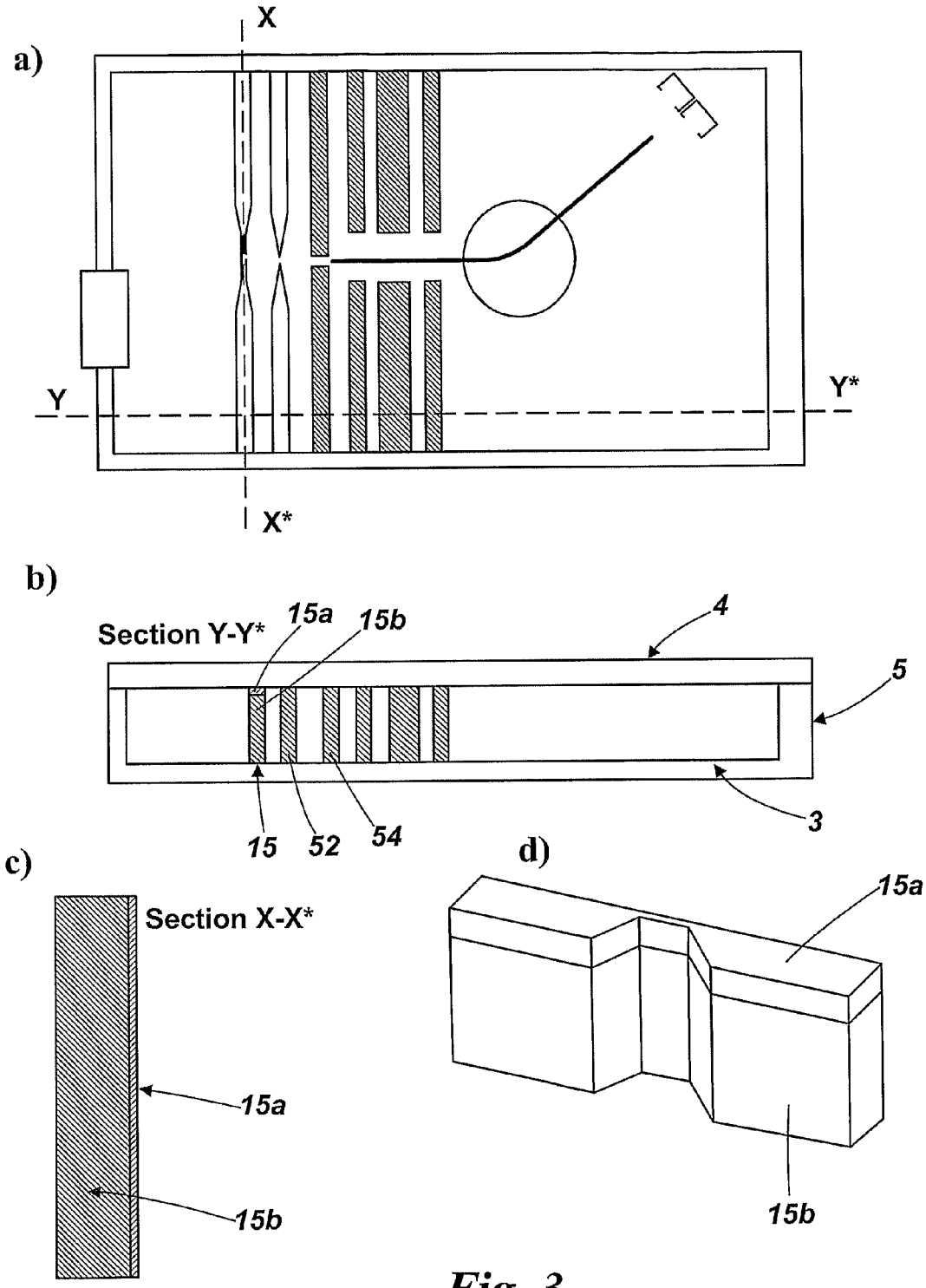
FIGS. 3*a, b, c* and *d* show schematically a perspective view of, and cross-sections through the mass discriminator element.

FIG. 2 shows the fusible device before fusing. In this example, the device is made from a silicon dioxide on silicon substrate with a metallization layer deposited on top. In FIG. 2 the lighter grey shows the metallization. In this example, the unbroken structure has a pre-weakened structure which is 100 μm long by 6 μm wide by 0.2 μm thick. The thickness is determined by the thickness of the metallization layer. The metallization preferably consists of a metal with the required physical properties, low melting temperature, good gas opacity, ease of deposition and good adhesion to the semiconductor substrate e.g. chromium, aluminium etc. The structure can be etched into a semiconductor substrate using the metallisation as a mask, or built up and then the metallisation coated on the top surface. FIG. 3 shows cross-sections of the analysis device. FIG. 3*b* shows a cross-section through the device of FIG. 3*a* along the line Y-Y* and additionally shows lid 4 and base 3 of the analysis device. FIG. 3*c* shows the fusible device in cross-section along the line X-X*. The lid is bonded to the sides 5 of the device such that the fusible device 40 is in contact with the lid. The metallisation layer 15*a* is on top of the non-conducting (e.g. semi-conductor) substrate 15*b* to form the fusible device, and is in contact with the lid. During manufacture the seal between the sample and analysis volumes is made when the lid is sealed on top. The wall 15 and fusible device 40 form a barrier between the two volumes.

Figure 4:
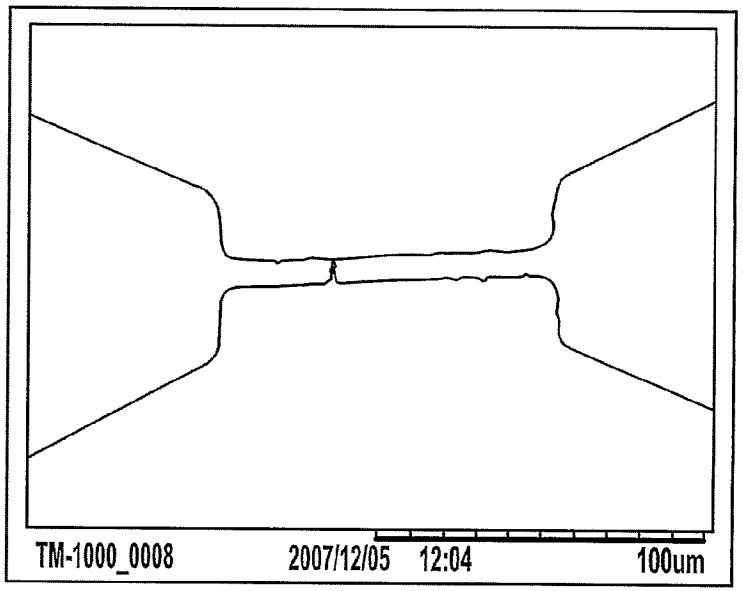
FIG. 4 is a micrograph of the wall of FIG. 2 after rupture.

FIG. 4 shows the fusible device after fusing in which a gap has opened. The gap in the fired sample is 1.2 mm wide. The fusible device shown in FIGS. 2 and 4 has a narrowed section which is narrowed from both sides. In another embodiment, the fusible device is narrowed from only one side as shown in the perspective view of FIG. 3*d*. The structure of FIG. 3*d* has an advantage over that of FIGS. 2 and 4 in that the reduced metallisation area requires less current to fuse the device and break to provide a gap. After fusing the gap formed in the metal layer will be adjacent to the lid and gas will flow from the sample chamber 10 to the discriminator chamber 20, i.e. the gas flows from left to right in FIGS. 1 and 3*a*, and from top to bottom in FIG. 4. In an alternative embodiment the fusible metallisation layer may be provided sandwiched between two semi-conductor substrates such that the gap can be generated at any point in the narrowed section of wall 15.

Figure 5:
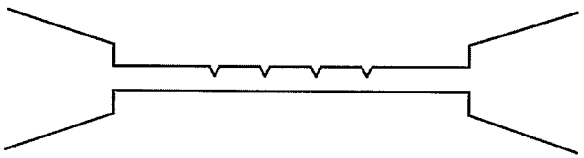
FIG. 5 shows schematically additional features that may be used to control the point of rupture.

The fusible device may additionally include features to control the positioning of the break when current is applied. As shown in FIG. 5, these features may take the form of shaped features such as thin sections or notches.

Alternatively to using the fusible device 40 to release the sample from the sample chamber, any type of micro-structured valve could be used, or a rupturable zone similar to that described above but which ruptures under the application of a mechanical force, such as by a twisting or cracking operation.

The fusible device 40 has the function of allowing the sample to pass from the sample chamber 10 to the discriminator chamber 20. It does not take part in the subsequent ion optics (to be described below) and hence, can be positioned at any point on the boundary between the sample chamber 10 and discriminator chamber 20.

In the discriminator chamber 20 after the fusible device 40 are a series of components. The components have a part which is active in the subsequent ion optics. The active part of each of these components lies on a common axis. The axis may be located centrally in the chamber 20, but is preferably offset slightly to one side of the chamber 20. All components in the ion separation region 50, and canyon electrode region 60 have a common axis.

The first set of features arranged after the wall 15 and fusible device 40 are those in the ion preparation region. Firstly, there is the spark gap electrode 52 which consists of a pair of electrodes. The pair of electrodes have a width of around 50 to 100 μm and extend from the chamber wall towards the common axis of the chamber 20. As the electrodes approach the common axis, the width tapers down to a point to provide a gap at the common axis and split the feature into the two required electrodes. The height of these electrodes is typically 100-200 μm (i.e. in FIG. 1 this is the out of plane direction). The gap between the tips of the points of the electrodes is 50-100 μm. The gap is sized such that when a sample, such as a sample gas, is passed between the gap and a voltage is applied across the gap between the electrodes a spark occurs. The spark arises due to the pressure/voltage/gap size requirements meeting the breakdown voltage requirements of the gas.

The spark gap electrode structures are fabricated on a non-conducting substrate. This could be a semiconductor substrate, glass, or silica grown on a silicon wafer. The electrodes themselves are formed of metal deposited on the non-conducting structure. The metal can be deposited in many ways, for example, as a powder with a binding matrix, or deposited by thin-film sputtering. Typically to generate a spark, 200-300 V is applied across the gap of 50-100 μm mentioned above. This results in an electric field of $\sim 2\times10^6$ Volts/meter. A similar electric field is required for other sized gaps.

The last component of the ion separation region 50 is the ion extraction electrode 54. This has a similar configuration to the spark gap electrode except that the ends of the electrodes close to the common axis of the chamber 20 are rectangular rather than tapering down to a point. The gap between the ion preparation electrodes is around 500 μm.

The ion extraction electrode has three main functions. Firstly, like the aperture provided by the fusible device 40, the aperture between the ion extraction electrodes 54 is small enough to provide impedance to the flow of material from the ion preparation region to the analysis region 70. Secondly, the electrodes are arranged such that a DC voltage can be applied to provide an electric field between the tips of the electrodes. This field assists with the extraction of positive ions from the ion preparation region 50. Thirdly, the field provided by these electrodes extends towards the neighbouring spark gap electrodes 52. Experiments have shown that this field causes the gas discharge at the spark gap electrodes 52 to extend beyond the spark gap region towards the ion extraction electrodes 54. This has the result of providing more ions. Hence, this electrode may also be known as the discharge sustain electrode.

The ion preparation electrode 54 could be produced in a similar manner to the fusible device 40 as this would provide a low conductance/flow rate aperture. However, the gap between the electrodes 54 needs to be positioned accurately on the common axis of the chamber. To achieve this, the ion preparation electrodes may be manufactured using the same technique as the spark gap electrodes 52.

After the ion preparation region 50, the next set of components in the mass discriminator chamber are the canyon electrodes 60. In the embodiment shown in FIG. 1, there are three pairs of canyon electrodes (identified by reference numerals 62, 64, 66). The canyon electrodes 60 act as a two-dimensional Einzel lens. Other types of ion beam focussing arrangements are known and may be used instead of the Einzel lens.

Figure 6:
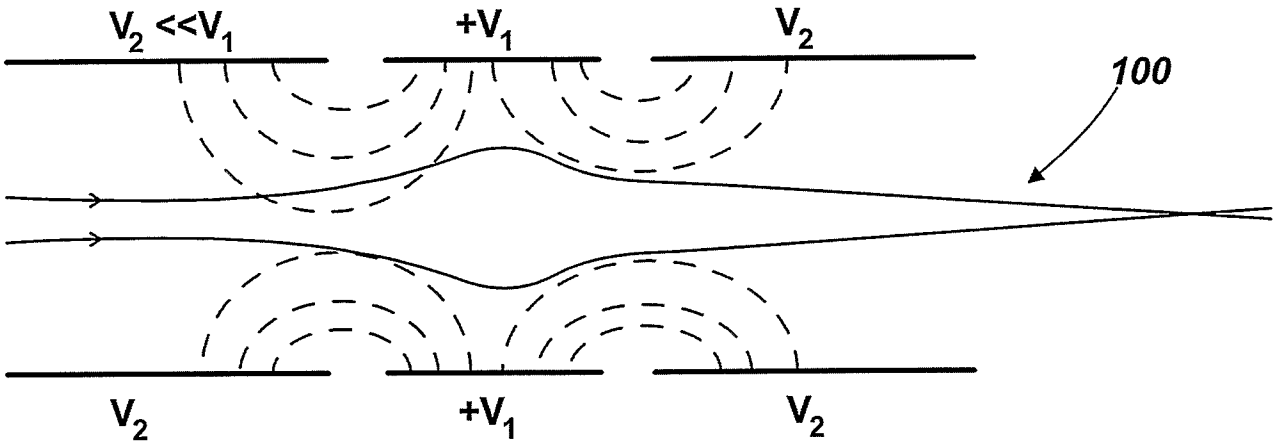
FIG. 6 illustrates the electric field lines in the region of an Einzel lens.

The canyon electrodes 60 are made using precision micro-fabrication techniques such as micromachining or printing. The canyon electrodes 60 are spaced apart 100-200 μm, and the gaps between the tips of each pair of electrodes is around 100-200 μm. The middle pair 64 of the three pairs of electrodes may be wider than the outer electrodes. FIG. 6 shows the electric field generated by the Einzel lens. The field lines are shown to indicate how the field focuses the ions. In this case, the Einzel lens is only a two-dimensional device because the mass-discriminator described herein is a planar device.

After the canyon electrodes 60, a pair of magnets 80 are arranged in the region of the path of the ion beam 100. (Only one magnet is shown in FIG. 1). The magnets 80 are placed such that one is above and the other is below the plane of the ion beam. The ion beam can pass through the space between the two magnets. Preferably, the magnets are strong permanent magnets such as Neodymium Iron Boride magnets, but other materials may be used. Electromagnets may also be used. Preferably, the magnets produce a magnetic field at the midpoint between them of approximately 0.3 Tesla. Any deflection of the ion beam caused by the magnetic field will be in the plane of the device due to the positions of the magnets above and below the plane of the device.

All of the electrodes 52, 54, 62, 64, 66 have the same cross-section at every height, that is they are right prisms.

At the far end of the analysis region 70 of the discriminator chamber 20 are Faraday cups 90. A Faraday cup is a metal cup that forms a conducting electrode. The cup is held at a potential such that any ions falling on it will cause a current to flow. The current induced is proportional to the number of incident ions. In the embodiment shown in FIG. 1, two cups are provided: one for each ion species of interest. The current from the Faraday cups 90 is provided to a low noise, low current measurement circuit (not shown). The two Faraday cups are used for detecting two species, such as the molecular ions of $^{12}CO_2$ and $^{13}CO_2$, or $C^{16}O_2$ and $C^{18}O_2$. The Faraday cups are located off axis to collect the ions after being deflected by the magnets 80. The Faraday cups may be fabricated, to be disposed in different positions depending on the ion species being examined In addition, more than two Faraday cups may be used if the presence of more than two species is being investigated.

Figure 7B:
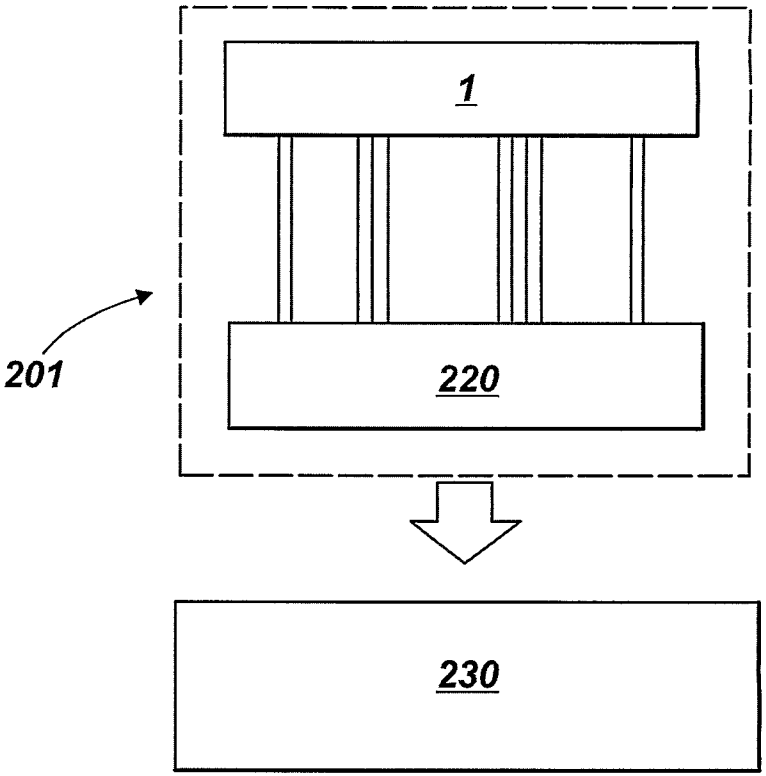
FIG. 7*b* is a schematic diagram of a mass discriminator system comprising the element of FIG. 1 according to a second embodiment.
Figure 7A:
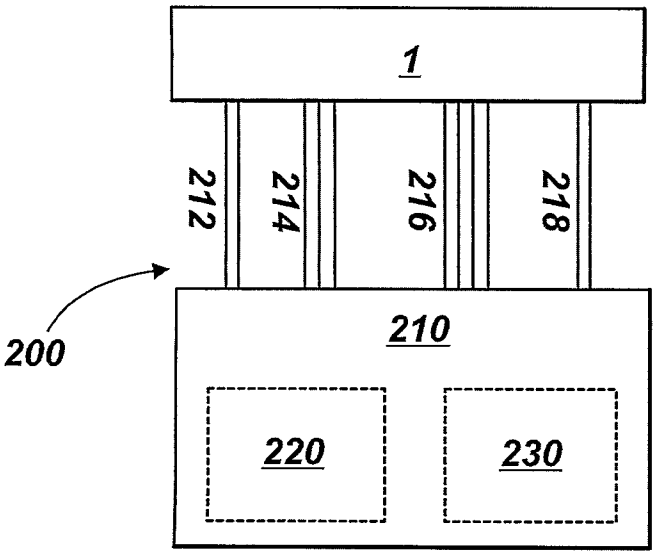
FIG. 7*a* is a schematic diagram of a mass discriminator system comprising the element of FIG. 1 according to a first embodiment.

The analysis device 1 may be included as part of a mass discriminator system 200 as shown in FIG. 7*a*. The system 200 includes a controller 210 for controlling the operation of the device or element 1. The controller 210 may include a control system 220 and an analysis system 230. The control system 220 may include a current source for supplying current to fuse or rupture the rupture zone of the wall separating the sample chamber and discriminator chamber. The control system 220 may also include voltage supplies for applying a potential difference across the various electrodes, for example, across the spark gap electrodes 52, and Einzel lens electrodes 60. The controller 210 is connected to the mass discriminator element by connections 212 (current source connections to fuse/rupture device), 214 (voltage connections to spark gap electrodes, and optionally ion extraction electrode), and 216 (voltage connections to canyon electrodes). The controller may also control the timing of the application of the currents and voltages to optimise the analysis process, such as the timing of the voltage across the spark gap based on a time since fusing of the fusible device 40, or based on the rise in pressure in the analysis chamber 20. The controller may also be connected 218 to the detectors to read the ion charge/current arriving at the detectors. The analysis system 230 may be arranged to perform a calculation on the detected ion charge/current to provide a user with an indication as to the contents of the sample. The controller 210 may be provided as a unit integrated with or to the device 1.

In an alternative embodiment, mass discriminator system 201 does not include analysis system 230. In this case, as shown in FIG. 7*b* the analysis system 230 may be provided in a separate base unit, such as a computer, to which the system 201 may connect. The system 201 of FIG. 7*b* is more compact and cheaper to manufacture than the system 200 of FIG. 7*a*. The system 201 may be provided as a small portable unit the size of a credit card, cigarette packet, or USB memory stick. The system 201 includes the mass discriminator element 1 and all control systems required to perform the measurement. The raw results of the measurement are stored until the unit is connected or plugged into a base station or computer 230. When connected the analysis of the results is provided to the user by analysis unit 230. The connection between discriminator system 201 and analysis system 230 may be by USB or other suitable connection. There follows a description of the operation of the analysis device 1 shown in FIG. 1.

As mentioned above the device 1 has two volumes: a sample chamber 10 and a mass-discriminator chamber 20. In the initial condition, before use, the two volumes are manufactured and held at a high vacuum of around $10^{-4}$ millibar ($10^{-2}$ Pa). This is maintained, as mentioned above, using clean low outgassing materials, and by including a getter material in the analysis region 70. A sample, such as a breath sample, is introduced through sample entry valve 30. The sample in general may be any gas sample, such as a mixed gas sample or even an aerosol. As the sample of breath is introduced, the pressure in the sample chamber 10 rises to around 1000 millibar ($10^5$ Pa).

The next step is to initiate the measurement sequence. Firstly the various voltages are applied to the respective electrodes. For example, the voltages are applied across the spark gap electrodes 52, ion extraction electrodes 54, and canyon electrodes 60. After this initialisation step, the measurement sequence can start. The sample gas is held in the sample chamber 10 and prevented from entering the discriminator chamber 20 by the presence of the fusible device 40. By rupturing the rupture zone which in the embodiment of FIG. 1, may be fusing the fusible device 40, an aperture in the fusible device 40 will open. The fusible device is fused by applying an electric current across the electrode. The electric current heats the conducting part of the fusible device causing the narrower pre-weakened section to melt or fuse. Once opened, the aperture will be of a size to restrict the flow of sample gas from the sample chamber 10 to the discriminator chamber 20. For example, as shown in FIG. 2, the aperture will be less than 5 μm in size, and preferably 1-2 μm. In the embodiment of FIG. 1, this aperture has the sole function of allowing the breath to pass from the sample reservoir to the ion preparation region, and takes no part in the ion optics.

After some of the sample gas has flowed through the fused fusible device 40, the pressure in the discriminator chamber 20 will rise.

The discriminator chamber 20 is divided into regions by the ion extraction electrode 54. The first region is the ion preparation region 20, and the second region is the analysis region 70. The ion extraction electrode 54 is also sized to slow the flow of sample gas. Hence, after rupturing the fusible device 40, the sample gas will flow into the ion preparation region 50 where the pressure will rise. A voltage of around 200 to 300 V is applied across the spark gap electrodes in the initialisation step above. The small (~100 μm) gap between the spark gap electrodes results in an electric field of around $2\times10^6$ Volts/meter. When the pressure in the ion preparation region 50 reaches around 1 millibar (100 Pa), an electrical discharge occurs spontaneously in the gas between the spark gap electrodes 52. The discharge is caused by breakdown and ionisation of the gas. As a result of the discharge a plasma is produced containing a mixture of positive and negative ions, electrons, and neutral gas atoms. If the discriminator is made of transparent material, the discharge may be visible. The discharge across the spark gap will coincide with the pressure wave of sample gas coming from the fused gap, due to the design of the gas flow, and pressure rise in the system.

The pressure in the ion preparation region 50 will continue to rise. The speed at which the pressure rises is determined by the impedance to the flow provided by the aperture in the fusible device 40. The electrical discharge continues for as long as the pressure in the ion preparation region 50 is maintained above a low pressure limit, P1, of around 0.5 millibar (50 Pa) and below a predetermined high pressure limit P2. If the pressure goes below the low pressure limit P1, the gas density is too low for the discharge to continue. The high pressure limit P2 is at least 10 millibar ($10^3$ Pa), and may be significantly higher than this, for example 100 millibar ($10^4$ Pa). At pressures above P2 the gas density is too high to maintain free electrons and ions. Hence, the gas density quenches the discharge. The pressure will eventually equalise in the entire system to about 300 millibar.

After ions have been generated by the spark gap electrodes 52, ions move towards the ion extraction electrodes 54. As mentioned above, the ion extraction electrode 54 provides a DC electric field which extends towards the spark gap electrodes 52 and assists in the extraction of ions. The ion extraction electrode 54 also provides an impedance to the flow of sample gas into the analysis region 70. The position of the ion extraction electrode 54 is on the common axis of the device to ensure ions are released onto the axis of the subsequent canyon electrodes 60.

The aperture between the ion extraction electrodes 54 allows the pressure in the analysis region 70 to rise from the initial high vacuum. As the pressure rises, the mean free path of the ions reduces. When the pressure reaches around $5\times10^{-3}$ millibar (0.5 Pa) the mean free path of the ions is too small to allow enough ions to reach the Faraday cup detectors 90 without colliding with neutral gas molecules. Thus, the electrode provides impedance to the flow of gas molecules in the ion preparation region 50 to maintain the pressure in the analysis region 70 below around $10^{-3}$ millibar (0.1 Pa). The impedance is sufficient to slow the rise of pressure to allow the measurement to take place.

The ion extraction electrodes 54 present ions at thermal energies to the canyon electrode region 60. In the embodiment of FIG. 1, the canyon electrodes 60 consist of three pairs of electrodes 62, 64, 66 which together form an Einzel type lens. The ions exiting the ion extraction electrodes 54 have a range of directions of motion. In fact, the directions take up an approximately $2\pi$ distribution. The canyon electrodes 60 take this distribution and funnel sufficient numbers of the ions exiting the ion extraction electrode 54 as an approximately linear beam 100. The voltages applied to the canyon electrodes 60 are selected to provide ions with a low energy of around, or slightly less than, 10 eV after passing through the canyon electrodes 60. In some applications, in Einzel lenses the outer electrodes 62, 66 are grounded, and the middle electrode 64 is held at a voltage of around 100-500 V. In the embodiment shown in FIG. 1, the two outer electrodes 62, 66 are held at a fixed voltage to provide the ions with the required energy. For example, a voltage of around 10 V would be applied to produce ions having a voltage of the order of 10 eV. Preferably, the electrodes are manufactured using precision micro-fabrication techniques which are precise enough to mean that none or little tuning of the voltages is required from one device to another to result in an operational device.

As mentioned above, an approximately linear and well confined beam of ions emerges from the output of the canyon electrodes 60. This beam passes between the pair of magnets 80. The ions are deviated by the magnetic field produced by the magnets such that the beam emerging from the magnets has been deflected by an angle with respect to the direction of the beam exiting the canyon electrodes 60. The magnets are arranged such that the direction of the magnetic field is perpendicular to the plane of the device 1, and the deviation of the ion beam is in the plane of the device 1. The magnitude of the deviation is dependent on the mass to charge ratio of the ions. Hence, for singly charged ions the angle of deviation is less for a heavy ion than for a lighter ion. For example, singly charged carbon-12 ions will be deviated more than singly charged carbon-13 ions. Since the deviation of the ion beam is an angular effect, ions having different mass to charge ratios will emerge from the magnets on slightly different and diverging paths.

At the end of the device, in the path of the deviated ion beam is a Faraday cup arrangement. One Faraday cup 90 is used to detect each ion species of interest. As ions fall on a Faraday cup 90, a small charge is built up on the cup. This charge is proportional to the number of ions that are incident on the cup. The built up charge can be read out as a current. The current from each Faraday cup is detected by a low noise current measurement circuit. In other embodiments a larger number of Faraday cup detectors may be used to record the spatial separation of the different ions, and thereby produce a different diagnostic. Alternatively, instead of discrete detectors, a detector array spanning a continuous range of deflections may be used.

In another alternative embodiment, multiple discriminator systems may be stacked together to analyse for a wider range of ion species than is possible with a single discriminator unit alone. Each discriminator of the stack would be arranged to detect different sets of ions. This could be achieved by changing the position of the detectors to match the differing amounts of deflection to the path of heavier or differently charged ions.

In one embodiment, the controller 210 may include a measurement circuit arranged to calculate a ratio of the charges or currents on each of the detectors. Alternatively, as shown in FIG. 7*b* the calculation may be performed in a device external to the system such as a computer connected to the system 230.

The calculated mass to charge ratio could be used to determine the biological uptake by a person of a particular chemical species. For example, a compound doped with a marker species such as carbon-13, nitrogen-15, or oxygen-18 may be ingested or injected into a patient. The speed with which the marker species arrives into the patient's breath may then be tested by using the device 1. The speed of uptake may determine if a patient has a particular disease, illness, or medical condition. The use of a ratio avoids calibration issues between individual devices because factors affecting one ion species will also affect the other ion species.

After initiation of the measurement process by rupturing the fusible device 40, the pressure inside the ion preparation region 50 and analysis region 70 will begin to rise. The measurement process must take place and be completed before the pressure in the ion preparation region 50 and analysis region 70 reaches unacceptable levels that prevent the generation of ions or reduce their mean free path such that only very small numbers of ions reach the detectors 90. The rising number of gas molecules may also deflect the ions by collisions or cause the ions to be neutralised.

Preferably, the apertures in the fusible device 40 and ion preparation electrodes have a diameter in the range 1-100 μm to ensure low flow rates through the apertures. Apertures having diameters in this range enable the pressure rise to take place over a period as long as 2 seconds, but can be as short as milliseconds. Because of the short duration of the measurement period, we sometimes call the technique "flash mass spectrometry".

The embodiment of FIG. 1 illustrates how a compact, low cost, mass discriminator may be achieved. The compactness of the device 1 means that it may be realised as a card which may be plugged into a base station, such as a computer or simple card reader device. The base station (see FIG. 7*b*) may perform analysis of the currents resulting from the detectors and provide a mass discriminator measurement output as a ratio of the numbers of selected ions present in the sample. The card may be approximately credit card sized but may have a greater thickness, or the size may be further reduced to provide a device the size of a USB memory stick. The device 1 is expected to be a single use apparatus that is dispose of after one use.

Figure 8:
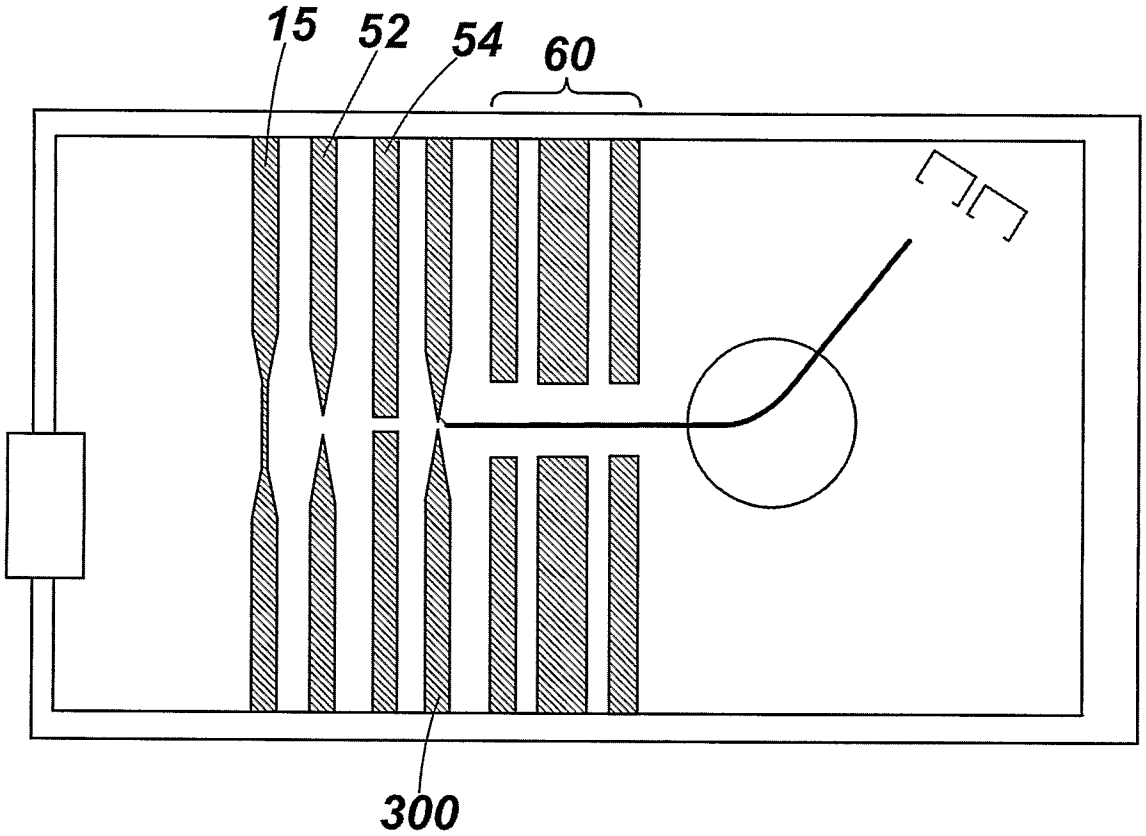
FIG. 8 is a schematic diagram of a mass discriminator according to a second embodiment.
Figure 9:
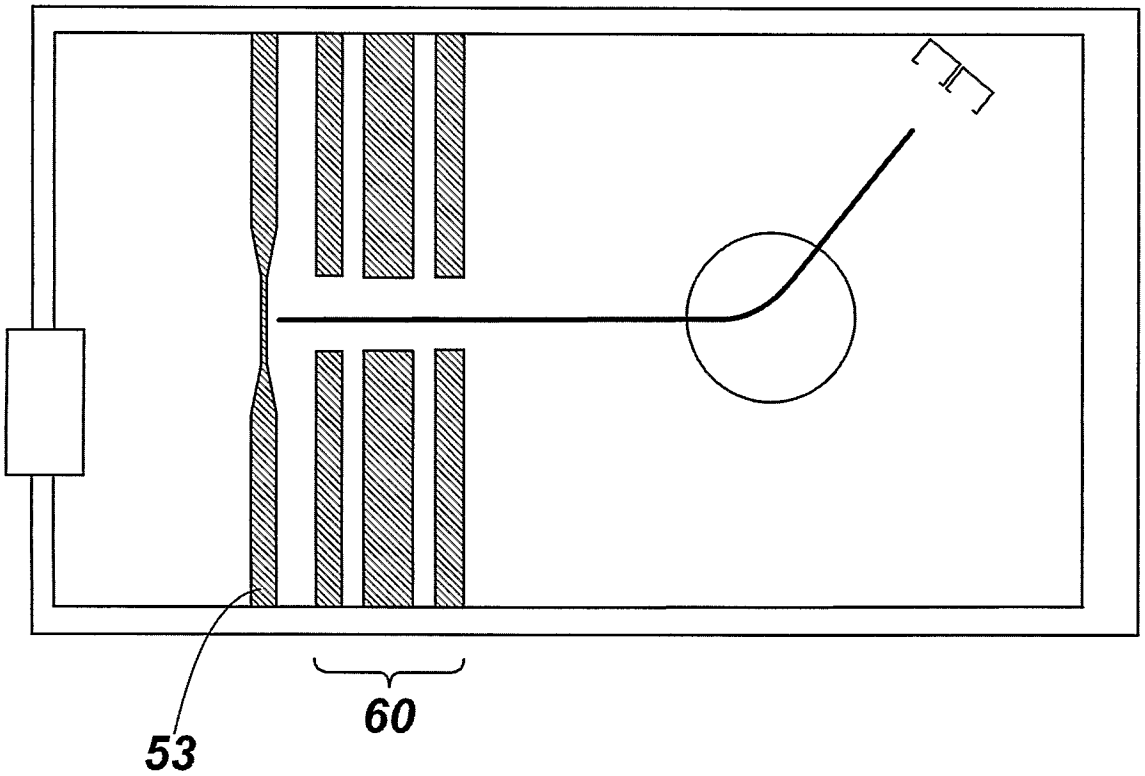
FIG. 9 is a schematic diagram of a mass discriminator according to a third embodiment.

Alternative embodiments of the mass discriminator device are shown in FIGS. 8 and 9.

FIG. 8 shows an additional filter 300 between the ion extraction electrodes 54 and canyon electrodes 60. The filter 300 provides a narrow gap arranged to prevent neutral particles, such as molecules from passing to the canyon electrodes 60. The filter may be manufactured using the same micromachining technologies as some of the other electrodes.

FIG. 9 shows a basic device in which the fusible device 40 and spark gap electrodes 52 are combined into a single electrode pair 53 which performs the functions of both electrodes. Additionally, as shown in FIG. 9, the ion extraction electrodes may not be included. For example, if the canyon electrodes 60 are provided with a narrow aperture, and the electrode 53 provides sufficient numbers of ions.

The person skilled in the art will readily appreciate that various modifications and alterations may be made to the above described mass discriminator element or system without departing from the scope of the appended claims, for example, different materials, dimensions and electrode configurations may be used.

The invention claimed is:

1. An analysis device, comprising:

a sample chamber for holding a gaseous sample;

an analysis chamber arranged to receive sample gas from the sample chamber;

a mass discriminator arranged to discriminate in the analysis chamber between ion species generated from the sample gas, the mass discriminator comprising detectors arranged to detect incident ions; and a wall separating the sample chamber from the analysis chamber, the wall comprising a rupture zone controllable to rupture and thereby release sample gas from the sample chamber into the analysis chamber, the rupture zone of the wall comprising a fusible device adapted to rupture on application of an electric current, the analysis chamber comprising an ion preparation region having spark gap electrodes for ionizing at least part of the sample gas as it flows through a gap between the spark gap electrodes, and wherein the flow rate of sample gas into the analysis chamber is controlled by an aperture of the rupture zone and the gap between the electrodes, and the mass discriminator is arranged such that a time window for discriminating between ion species is the time between rupture of the rupture zone and sample gas pressure in the analysis chamber preventing ions reaching the detectors.

2. The device of claim 1, wherein the sample chamber is closed by an admission valve arranged for introduction of said sample into the sample chamber.

3. The device of claim 1, wherein the rupture zone is comprised of a thinner section than the rest of said wall.

4. The device of claim 1, wherein the wall is micromachined.

5. The device of claim 1, wherein the ion preparation region is for generating ions from the sample.

6. The device of claim 5, wherein the mass discriminator further comprises:

a lensing region arranged to focus the ions into an ion beam; and a magnet arranged for deflecting the ion beam.

7. The device of claim 4, wherein the spark gap electrodes are a pair and are arranged such that on application of a potential difference across the spark gap electrodes or between the spark gap electrodes and neighbouring electrodes an electrical discharge is generated thereby ionising the sample as it flows through said gap.

8. The device of claim 1, wherein before a sample is introduced into the sample chamber, the sample chamber and analysis chamber are evacuated.

9. The device of claim 7, wherein the sample chamber and analysis chamber are evacuated to a pressure less than $10^{-2}$ Pa.

10. The device of claim 7, wherein the spark gap electrodes and potential difference applied across the spark gap electrodes, or between the spark gap electrodes and neighbouring electrodes, are arranged such that the electrical discharge is generated when the pressure in the or part of the analysis chamber exceeds a threshold.

11. The device of claim 10, wherein the threshold of the pressure in the or part of the analysis chamber is 100 Pa.

12. The device of claim 7, wherein the ion preparation region further comprises a pair of ion extraction electrodes.

13. The device of claim 12, wherein the ion extraction electrodes are arranged to provide an electric field in the region of the spark electrodes.

14. The device of claim 6, wherein the lensing region comprises an Einzel lens.

15. The device of claim 14, wherein the Einzel lens comprises three electrode pairs, each pair having a gap there between through which ions can pass.

16. The device of claim 6, wherein the magnet comprises Neodymium Iron Boride.

17. The device of claim 6, wherein the detectors are Faraday cups.

18. The device of claim 1, wherein a getter material is provided in the analysis chamber.

19. The device of claim 1, manufactured by micromachining.

20. The device of claim 1, comprising electrical terminals for external connection to the rupture zone.

21. An analysis system comprising the device of claim 1 and further comprising a controller arranged to provide the electric current to the rupture zone.

22. The analysis system of claim 21, wherein the controller comprises a current source and a switch.

23. The analysis system of claim 21, wherein the spark gap electrodes are a pair and are arranged such that on application of a potential difference across the spark gap electrodes, or between the spark gap electrodes and neighbouring electrodes, an electrical discharge is generated thereby ionising the sample as it flows through said gap, and the controller is further arranged to provide the potential difference across the spark gap electrodes or between the spark gap electrodes and neighbouring electrodes.

24. The analysis system of claim 23, wherein the controller comprises a voltage source and a second switch.

25. The analysis system of claim 21, further comprising readout means arranged to display an ion species analysis result to a user.

26. The analysis system of claim 25, wherein the device is provided in a first unit, the readout means is provided in a second unit, the first unit being arranged to detachably couple to the second unit for transferring the ion species analysis result from the first unit to the second unit.

27. A method of mass discrimination using an analysis device comprising a sample chamber and an analysis chamber separated from the sample chamber by a wall, the wall comprising a rupture zone controllable to rupture, the method comprising the steps of:

introducing a gaseous sample into the sample chamber;

causing the wall to rupture at the rupture zone thereby releasing the sample through the wall into the analysis chamber;

generating ion species from the gaseous sample released into the analysis chamber; and discriminating between the ion species generated from the sample gas with a mass discriminator in the analysis chamber, the mass discriminator comprising detectors for detecting incident ions, the rupture zone comprising a fusible device, the fusible device is caused to rupture by the application of an electric current, the step of generating comprising ionizing at least part of the sample gas as it flows through a gap between spark gap electrodes in the analysis chamber, wherein the flow rate of sample gas into the analysis chamber is controlled by an aperture of the rupture zone and gaps between the electrodes, and the step of discriminating occurring for a time window between a time of rupture of the rupture zone and sample gas pressure in the analysis chamber preventing ions reaching the detectors.

28. The method of claim 27, wherein the step of generating ion species comprises: applying a potential difference across a pair of spark gap electrodes, or between the spark gap electrodes and neighbouring electrodes, in the analysis chamber to generate an electrical discharge across the electrodes, the electrical discharge ionising the sample.

29. The method of claim 27, wherein before the introduction of the gaseous sample into the sample chamber, the sample chamber and analysis chamber are evacuated.

30. The method of claim 29, wherein the sample chamber and analysis chamber are evacuated to a pressure of less than $10^{-2}$ Pa.

31. The method of claim 27, wherein pressure in the analysis chamber rises after the step of causing the wall to rupture, and the step of generating ion species occurs after the pressure in the or part of the analysis chamber exceeds a threshold.

32. The method of claim 31, wherein the threshold of the pressure in the or part of the analysis chamber is 100 Pa.

33. The device of claim 5, comprising electrical terminals for external connection to the ion preparation region.

34. The device of claim 6, comprising electrical terminals for external connection to at least one of the lensing region, and the detectors.

35. A method of mass discrimination using an analysis device comprising a sample chamber and an analysis chamber separated from the sample chamber by a wall, the wall comprising a rupture zone controllable to rupture, the analysis chamber initially evacuated, the method comprising the steps of:

introducing a gaseous sample into the sample chamber;

applying a voltage across spark gap electrodes or between spark gap electrodes and neighbouring electrodes in the analysis chamber, the voltage sufficient to cause electrical breakdown when the gas pressure exceeds a threshold;

causing the wall to rupture at the rupture zone thereby creating a first aperture in the wall to release the sample through the wall into the analysis chamber;

the pressure in the analysis chamber rising after the step of causing the wall to rupture;

generating ion species from the gaseous sample released into the analysis chamber by the voltage applied across the spark gap electrodes or between the spark gap electrodes and neighbouring electrodes; and discriminating between the ion species generated from the sample gas, wherein the first aperture in the wall, and/or a second aperture between the electrodes, is sized to regulate the flow of the gaseous sample from the sample chamber to the analysis chamber, and the step of generating ion species comprises generating a discharge which is spontaneously turned on by the rising pressure wave of gaseous sample flowing from the first and/or second aperture and between the spark gap electrodes, the rising pressure wave exceeding the threshold.

36. The method of claim 35, wherein the analysis chamber comprises an ion preparation region for generating ions from the sample, the ion preparation region including the spark gap electrodes, and the discharge across the spark gap electrodes occurring spontaneously when the pressure in the ion preparation region reaches a threshold.

37. The method of claim 36, wherein control of the timing of the start of discharge occurs passively based on a pressure rise in the ion preparation region.

38. The method of any of claims 35 or 36-37, wherein the flow of gaseous sample from sample chamber to analysis chamber is passively controlled by the first and/or second aperture.

39. The method of any of claims 35 or 36, wherein the discharge continues until the pressure between the electrodes generating ion species reaches a second threshold.

40. The method of claim 37, wherein the step of discriminating continues until the pressure in the analysis chamber rises to a level where the mean free path of the ion species is reduced to prevent ion species reaching the detectors.

41. An analysis device, comprising:

a sample chamber for holding a gaseous sample;

an analysis chamber arranged to receive sample gas from the sample chamber, the analysis chamber being evacuated;

spark gap electrodes in the analysis chamber for generating ion species from the sample gas;

a controller arranged to apply a voltage across spark gap electrodes or between spark gap electrodes and neighboring electrodes in the analysis chamber, the voltage sufficient to cause electrical breakdown when the gas pressure exceeds a threshold, the controller applying the voltage prior to the sample gas entering the analysis chamber;

a mass discriminator arranged to discriminate in the analysis chamber between ion species generated from the sample gas; and a wall separating the sample chamber from the analysis chamber, the wall comprising a rupture zone controllable to rupture and thereby create a first aperture to release the sample gas from the sample chamber into the analysis chamber, wherein the first aperture in the wall, and/or a second aperture between the electrodes, is sized to regulate the flow of the sample gas from the sample chamber to the analysis chamber, and the first aperture and/or second aperture, electrodes and voltage are arranged such that the discharge is spontaneously turned on when the pressure of the sample gas flowing from the first and/or second aperture and between the spark gap electrode exceeds the threshold.

42. The analysis device of claim 41, wherein the analysis chamber further comprises an ion preparation region for generating ions from the sample gas, the ion preparation region comprising the electrodes arranged to be applied with a voltage to generate the discharge, the electrodes being spark gap electrodes.

43. The analysis device of any of claims 41-42, wherein the first and/or second aperture passively control the flow of gaseous sample from sample chamber to analysis chamber.

44. The analysis device of any of claims 41-42, wherein the first aperture is less than 5 μm.

45. The analysis device of claim 43, wherein the first aperture is less than 5 μm.

46. The method of any of claims 41-42, wherein the discharge continues until the pressure between the electrodes generating ion species reaches a second threshold.

47. The method of claim 43, wherein the discharge continues until the pressure between the electrodes generating ion species reaches a second threshold.

48. The method of claim 44, wherein the discharge continues until the pressure between the electrodes generating ion species reaches a second threshold.

49. The method of claim 45, wherein the discharge continues until the pressure between the electrodes generating ion species reaches a second threshold.

* * * * *